US012247812B1

(12) United States Patent
Shi

(10) Patent No.: US 12,247,812 B1
(45) Date of Patent: Mar. 11, 2025

(54) DART GAME APPARATUS

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/801,918

(22) Filed: Aug. 13, 2024

(30) Foreign Application Priority Data

Jun. 19, 2024 (CN) ..... 202421415522.3

(51) Int. Cl.
*F41J 3/00* (2006.01)
*F41J 5/04* (2006.01)
*F41J 5/14* (2006.01)

(52) U.S. Cl.
CPC ..... *F41J 3/0047* (2013.01); *F41J 5/04* (2013.01); *F41J 5/14* (2013.01)

(58) Field of Classification Search
CPC .. F41J 3/00; F41J 3/0004; F41J 3/0009; F41J 3/0014; F41J 3/0019; F41J 3/0023; F41J 3/0028; F41J 3/0033; F41J 3/0038; F41J 3/0042; F41J 3/0057; F41J 3/0061; F41J 3/0066; F41J 3/0071; F41J 3/0076; F41J 3/008; F41J 3/0085; F41J 3/009; F41J 3/0095; F41J 3/02
USPC ..... 273/348
See application file for complete search history.

(56) References Cited

U.S. PATENT DOCUMENTS 1,525,339 A * 2/1925 Toohey ..... F41J 3/0019 273/407
1,639,846 A * 8/1927 Green ..... F41A 23/12 89/40.06
2,092,162 A * 9/1937 Hiatt ..... A63F 9/0208 273/348.5
2,099,908 A * 11/1937 Rosengarten ..... F41J 3/0095 473/193
2,170,850 A * 8/1939 Bonnett ..... F41J 3/0038 D21/303
2,179,471 A * 11/1939 Lee ..... F41J 3/02 273/368
2,618,484 A * 11/1952 Bishop ..... F41J 3/0019 248/455
3,164,384 A * 1/1965 Stewart ..... F41J 3/0004 273/404
3,894,736 A * 7/1975 Foley ..... F41J 3/0047 473/574
3,949,989 A * 4/1976 Van Meter ..... F41J 3/0047 273/348
4,098,009 A * 7/1978 Flynn ..... G09B 11/06 434/432
4,609,174 A * 9/1986 Nakatani ..... F16M 11/046 248/168

(Continued)

*Primary Examiner* — Joseph B Baldori
(74) *Attorney, Agent, or Firm* — Cooper Legal Group, LLC

(57) ABSTRACT

A dart game apparatus includes a target mechanism, a first support frame, a second support frame and an adjustment mechanism, an end of the first support frame is detachably connected with the target mechanism, an end of the second support frame is rotatably connected with the target mechanism, and the adjustment mechanism is arranged between the first support frame and the second support frame to adjust an included angle between the first support frame and the second support frame.

5 Claims, 2 Drawing Sheets

(56) References Cited

U.S. PATENT DOCUMENTS 4,804,193 A * 2/1989 Lin ..... F41J 5/052 273/376
4,824,120 A * 4/1989 Wang ..... F41J 1/00 273/348.5
5,308,035 A * 5/1994 Ross ..... A47B 97/04 248/460
5,531,450 A * 7/1996 Lu ..... F41J 3/0019 273/348.5
5,570,889 A * 11/1996 Tyrer ..... A63B 63/00 273/DIG. 30
5,613,686 A * 3/1997 Yiu ..... F41J 3/00 273/348.5
5,743,534 A * 4/1998 Pan ..... F41J 3/00 273/378
5,848,792 A * 12/1998 Brejcha ..... F41J 5/052 273/376
6,053,499 A * 4/2000 Yiu ..... F41J 3/00 273/374
6,708,976 B2 * 3/2004 Cho ..... F41J 5/052 273/374
7,866,668 B2 * 1/2011 Huang ..... F41J 3/00 273/376
8,764,016 B2 * 7/2014 Stewart ..... F41J 5/052 273/377
9,568,286 B1 * 2/2017 Carrillo Fuentevilla ..... F41J 3/0004
10,048,044 B1 * 8/2018 Berk ..... F41J 3/0047
10,267,602 B2 * 4/2019 Carrillo Fuentevilla ..... F41J 3/0004
10,465,838 B2 * 11/2019 Lin ..... F16M 11/046
10,677,571 B2 * 6/2020 Oh ..... F41J 3/02
10,724,832 B2 * 7/2020 Washington ..... F41J 3/00
11,833,438 B2 * 12/2023 Dong ..... F41J 5/08
2004/0026863 A1 * 2/2004 Cho ..... F41J 3/0047 273/348.5
2016/0016075 A1 * 1/2016 Berk ..... A63F 9/0278 273/348.4
2021/0239438 A1 * 8/2021 Yamamoto ..... F41J 3/00

* cited by examiner

A

DART GAME APPARATUS

CROSS-REFERENCE TO RELATED APPLICATION

The present application is based on and claims the priority benefits of China application No. 202421415522.3, filed on Jun. 19, 2024. The entirety of China application No. 202421415522.3 is hereby incorporated by reference herein and made a part of this specification.

TECHNICAL FIELD

The present application relates to the field of game device technologies, and in particular, to a dart game apparatus.

BACKGROUND ART

The dart game is a popular leisure and recreational activity, and the development of devices thereof has always be concerned. Traditional dart game targets are usually permanently fixed on walls, which is simple but has much inconvenience. For example, nails may be required to be driven into the wall during mounting, which not only detracts from aesthetics of the wall, but also may leave unmanageable marks when the dart game is no longer required. In a non-game time, the target still occupies a space and is inconvenient to store and carry.

In order to solve the above problems, some dart game apparatuses on the market are equipped with stands. Such a stand is intended to provide a movable target support structure, to avoid damage to the wall and improve the use flexibility of the target.

However, the existing dart game stand often has complex design and is difficult to disassemble and assemble, which limits the convenience of use and storage to a certain extent, and also affects market promotion and application of the product.

SUMMARY

In order to improve the convenience of use and storage of a dart game apparatus, the present application provides a dart game apparatus.

The following technical solution is adopted for the dart game apparatus according to the present application.

A dart game apparatus includes a target mechanism, a first support frame, a second support frame and an adjustment mechanism, an end of the first support frame is detachably connected with the target mechanism, an end of the second support frame is rotatably connected with the target mechanism, and the adjustment mechanism is arranged between the first support frame and the second support frame to adjust an included angle between the first support frame and the second support frame.

By adopting the above technical solution, the dart game apparatus is first assembled in use, and then, the included angle between the first support frame and the second support frame is adjusted by the adjustment mechanism to realize a stable support of the target mechanism by the first support frame and the second support frame. The structures of the target mechanism, the first support frame, the second support frame, the adjustment mechanism, and the like, are adopted in the present application, which brings convenience to disassembly and assembly of a stand while realizing a stable support. The end of the first support frame is in insertion fit with the target mechanism, and the end of the second support frame is rotatably connected with the target mechanism, such that the included angle between the first support frame and the second support frame may be adjusted by rotating the second support frame, so as to adjust the height of the target mechanism while improving the convenience of use and storage of the dart game apparatus, which meets demands of different users and improves the flexibility and convenience of the game.

Optionally, the adjustment mechanism includes a first adjustment component, a second adjustment component and a connector, the first adjustment component is in sliding fit with the first support frame, the second adjustment component is in sliding fit with the second support frame, a first end of the connector is rotatably connected with the first adjustment component, and a second end of the connector is rotatably connected with the second adjustment component.

With the above technical solution, the first adjustment component is in sliding fit with the first support frame, such that the position of the first adjustment component may be conveniently adjusted along a length direction of the first support frame. The second adjustment component is in sliding fit with the second support frame, such that the position of the second adjustment component may be conveniently adjusted along the length direction of the second support frame. Meanwhile, the first end of the connector is rotatably connected with the first adjustment component while the second end of the connector is rotatably connected with the second adjustment component, such that when the first support frame and the second support frame are in an unfolded state, a triangular structure is formed by the first support frame, the second support frame and the connector together, and because the triangular structure has a stable characteristic, thus the stability of the target mechanism supported by the first support frame and the second support frame is improved. Additionally, The second support frame is rotatably connected with the target mechanism, such that the included angle between the first support frame and the second support frame may be conveniently adjusted by adjusting the positions of the first adjustment component and the second adjustment component, so as to adjust the height of the target mechanism.

Optionally, the connector includes a connection rod and a clamping component, a first end of the connection rod is rotatably connected with the first adjustment component, a second end of the connection rod is detachably connected with the clamping component, a snapping groove for the second adjustment component to pass through is formed at a side of the clamping component, and when the clamping component is sleeved on the second adjustment component, the clamping component has a clamping effect on the second adjustment component.

With the above technical solution, when the height of the target mechanism is required to be adjusted, the included angle between the first support frame and the second support frame is first adjusted by rotating the second support frame. Then the position of the first adjustment component is adjusted along the length direction of the first support frame, such that the first adjustment component is moved to a suitable height. Then, the position of the second adjustment component is adjusted along the length direction of the second support frame, to move the second adjustment component to a suitable height. Finally, the connection rod is rotated, the clamping component is brought to move towards the second adjustment component in the rotating process of the connection rod. When the clamping component moves to the position of the second adjustment component and the second adjustment component penetrates through the snapping groove, the snapping groove clamps the second adjustment component, such that the clamping portion is fixed on the second adjustment component. At this point, the connector has a fixing effect on the second support frame, which improves the stability of the target mechanism supported by the first support frame and the second support frame.

Optionally, the target mechanism includes a dartboard, the end of the first support frame is configured to be inserted into the dartboard, a plurality of columns are provided on a surface of the dartboard, and a cross sectional area of each of the plurality of columns at a top thereof is smaller than the cross sectional area of each of the plurality of columns at a bottom thereof, such that a dart is caught by the bottoms of two adjacent ones of the plurality of columns when the dart is thrown to a position between the two adjacent ones of the plurality of columns.

With the above design, the dart is not required to be provided with a spine portion, thus improving safety of the game.

Optionally, the plurality of columns are made of an elastically deformable material.

In the above technical solution, the column is made of an elastically deformable material, thus ensuring that the dart may be stably caught between the adjacent columns, reducing damage to the dart and the columns, and additionally improving overall safety of the dart game apparatus.

Optionally, the target mechanism is divided into a plurality of different regions by different colors, and the plurality of different regions correspond to different scores, respectively.

The design makes the game more challenging and interesting, and a user may obtain corresponding scores for competition or entertainment according to the darts thrown on different regions.

Optionally, the target mechanism is provided with a plurality of detection elements, and the plurality of detection elements are arranged in a matrix corresponding to the plurality of columns in arrangement, to detect whether the dart is on a corresponding region.

The region with the dart may be determined by detecting the conducted detection element, and corresponding scoring is carried out. The design achieves an automatic scoring function, and improves the convenience and accuracy of the game.

Optionally, each of the plurality of detection elements is provided with a positive electrode film and a negative electrode film which are not connected with each other in an original state, and when the dart is caught between corresponding adjacent ones of the plurality of columns, the dart is in contact with the dartboard, and the positive electrode film and the negative electrode film of a respective one of the plurality of detection elements at a corresponding position are in contact and connected with each other.

The above design achieves an automatic scoring function, and improves the convenience and accuracy of the game.

Optionally, the target mechanism further includes a controller, the controller is electrically connected with the plurality of detection elements, to determine which one of the plurality of different regions has the dart according to the detection element, positive electrode film and the negative electrode film of a respective one of the plurality of detection elements at a corresponding position are in contact and connected with each other, and perform a corresponding scoring.

By adopting the above technical solution, the controller may detect the region with the dart while performing corresponding scoring according to a detection result.

Optionally, the target mechanism includes a display screen, and the display screen is electrically connected with the controller, to display a scoring result.

The above design enables the user to visually check a throwing result and a score, thus enhancing interactivity and experience of the game.

In summary, the present application may achieve at least one of the following beneficial effects.

1. When in use, the dart game apparatus is first assembled, and then, the included angle between the first support frame and the second support frame is adjusted by the adjustment mechanism to realize a stable support of the target mechanism by the first support frame and the second support frame. The structures of the target mechanism, the first support frame, the second support frame, the adjustment mechanism, and the like, are adopted in the present application, which brings convenience to disassembly and assembly of a stand while realizing a stable support. The end of the first support frame is in insertion fit with the target mechanism, and the end of the second support frame is rotatably connected with the target mechanism, such that the included angle between the first support frame and the second support frame may be adjusted by rotating the second support frame, so as to adjust the height of the target mechanism while improving the convenience of use and storage of the dart game apparatus, which meets demands of different users and improves the flexibility and convenience of the game.

2. The first adjustment component is in sliding fit with the first support frame, such that the position of the first adjustment component may be conveniently adjusted along a length direction of the first support frame. The second adjustment component is in sliding fit with the second support frame, such that the position of the second adjustment component may be conveniently adjusted along the length direction of the second support frame. Meanwhile, one end of the connector is rotatably connected with the first adjustment component while the other end of the connector is rotatably connected with the second adjustment component, such that when the first support frame and the second support frame are in an unfolded state, a triangular structure is formed by the first support frame, the second support frame and the connector together, and because the triangular structure has a stable characteristic, thus the stability of the target mechanism supported by the first support frame and the second support frame is improved. Additionally, the second support frame is rotatably connected with the target mechanism, such that the included angle between the first support frame and the second support frame may be conveniently adjusted by adjusting the positions of the first adjustment component and the second adjustment component, so as to adjust the height of the target mechanism.

3. When the height of the target mechanism is required to be adjusted, the included angle between the first support frame and the second support frame is first adjusted by rotating the second support frame. Then the position of the first adjustment component is adjusted along the length direction of the first support frame, such that the first adjustment component is moved to a suitable height. Then, the position of the second adjustment component is adjusted along the length direction of the second support frame to move the second adjustment component to a suitable height. Finally, the connection rod is rotated, the clamping component is brought to move towards the second adjustment component in the rotating process of the connection rod. When the clamping component moves to the position of the second adjustment component and the second adjustment component penetrates through the snapping groove, the snapping groove clamps the second adjustment component, such that the clamping portion is fixed on the second adjustment component. At this point, the connector has a fixing effect on the second support frame, which improves the stability of the target mechanism supported by the first support frame and the second support frame.

DETAILED DESCRIPTION

The present application will be further described below in details with reference to FIGS. 1 to 3.

The terminology used herein is for the purpose of describing particular embodiments only and is not intended to limit the present application. Unless defined otherwise, technical or scientific terms used herein shall have the ordinary meaning as understood by those skilled in the art to which the present application belongs. The terms "first", "second", or the like, used herein do not denote any order, quantity, or importance, but rather serve to distinguish different components.

First Embodiment

The embodiment of the present application discloses a dart game apparatus. Referring to FIG. 1, the dart game apparatus includes a target mechanism 1, a first support frame 2, a second support frame 3 and an adjustment mechanism.

Figure 1:
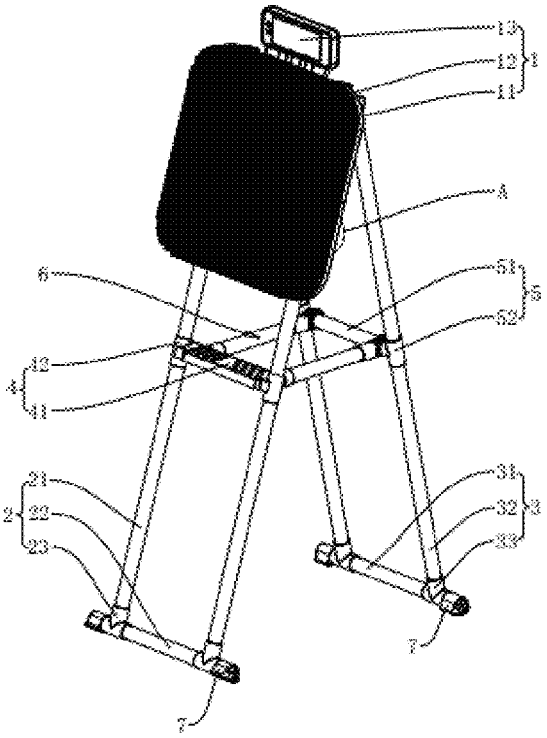
FIG. 1 is a schematic structural diagram of a dart game apparatus according to an embodiment of the present application.

With continued reference to FIG. 1, an end of the first support frame 2 close to the target mechanism 1 is detachably connected with the target mechanism 1, and an end of the second support frame 3 is rotatably connected with the target mechanism 1. The adjustment mechanism is arranged between the first support frame 2 and the second support frame 3, to adjust an included angle between the first support frame 2 and the second support frame 3, and the included angle specifically ranges from 0° to 90°. By adjusting the included angle between the first support frame 2 and the second support frame 3, a height of the target mechanism 1 may be adjusted, additionally, the convenience of use and storage of the dart game apparatus are improved to meet demands of different users.

With continued reference to FIG. 1, in the present embodiment, the first support frame 2 includes a first cross rod 22 and two first support rods 21, and top ends of the two first support rods 21 are configured to be inserted in the target mechanism 1, which improves the convenience of mounting and dismounting the two first support rods 21 by a worker. An end of each of the two first support rods 21 away from the target mechanism 1 is sleeved with a first T-shaped sleeve 23, and the first T-shaped sleeves 23 are fixedly connected with the first support rods 21. The first cross rod 22 penetrates through the two first T-shaped sleeves 23 simultaneously, and the first cross rod 22 is fixedly connected with the two first T-shaped sleeves 23, thus improving the convenience of mounting and dismounting the first support frame 2 by the worker.

With continued reference to FIG. 1, the second support frame 3 includes a second cross rod 31 and two second support rods 32, and top ends of the two second support rods 32 are both rotatably connected with the target mechanism 1. An end of each of the two second support rods 32 away from the target mechanism 1 is sleeved with a second T-shaped sleeve 33, and the second T-shaped sleeves 33 are fixedly connected with the second support rods 32. The second cross rod 31 penetrates through the two second T-shaped sleeves 33 simultaneously, and the second cross rod 31 is fixedly connected with the two second T-shaped sleeves 33, thereby improving the convenience of mounting and dismounting the second support frame 3 by the worker.

With continued reference to FIG. 1, buffer seats 7 are detachably connected to two ends of the first cross rod 22 and two ends of the second cross rod 31, respectively. When the dart game apparatus is placed on the ground, the buffer seats 7 at the two ends of the first cross rod 22 support and buffer the first cross rod 22, and the buffer seats 7 at the two ends of the second cross rod 31 support and buffer the second cross rod 31, thereby prolonging service lives of the first cross rod 22 and the second cross rod 31.

With continued reference to FIG. 1, a bottom of the buffer seat 7 is arc-shaped, such that when the included angle between the first support frame 2 and the second support frame 3 changes, it may be ensured that the buffer seat 7 is in full contact with the ground, thereby improving the stability of the target mechanism 1 supported by the first support frame 2 and the second support frame 3.

With continued reference to FIG. 1, the bottom of each buffer seat 7 is provided with a plurality of skidproof stripes, so as to further increase the friction force between the buffer seat 7 and the ground, thereby further improving the stability of the target mechanism 1 supported by the first support frame 2 and the second support frame 3.

With continued reference to FIG. 1, the adjustment mechanism includes a first adjustment component 4, a second adjustment component 5 and a connector 6, the first adjustment component 4 is in sliding fit with the first support frame 2, and the second adjustment component 5 is in sliding fit with the second support frame 3. One end of the connector 6 is rotatably connected with the first adjustment component 4, and the other end of the connector 6 is rotatably connected with the second adjustment component 5. The first adjustment component 4 is in sliding fit with the first support frame 2, such that the position of the first adjustment component 4 may be conveniently adjusted along a length direction of the first support frame 2. The second adjustment component 5 is in sliding fit with the second support frame 3, such that the position of the second adjustment component 5 may be conveniently adjusted along the length direction of the second support frame 3. Meanwhile, one end of the connector 6 is rotatably connected with the first adjustment component 4 while the other end of the connector 6 is rotatably connected with the second adjustment component 5, such that when the first support frame 2 and the second support frame 3 are in an unfolded state, a triangular structure is formed by the first support frame 2, the second support frame 3 and the connector 6 together, and because the triangular structure has a stable characteristic, the stability of the target mechanism 1 supported by the first support frame 2 and the second support frame 3 is improved. Additionally, The second support frame 3 is rotatably connected with the target mechanism 1, such that the included angle between the first support frame 2 and the second support frame 3 may be conveniently adjusted by adjusting the positions of the first adjustment component 4 and the second adjustment component 5, so as to adjust the height of the target mechanism 1.

With continued reference to FIG. 1, in the present embodiment, the first adjustment component 4 includes a first connection section 41, adjustment sleeves 42 are integrally formed at two ends of the first connection section 41, respectively. The two adjustment sleeves 42 correspond to the two first support rods 21 one by one, and each first support rod 21 penetrates through one adjustment sleeve 42. The adjustment sleeve 42 is in sliding fit with the first support rod 21, such that the position of the first adjustment component 4 may be adjusted conveniently along the length direction of the first support rod 21, and meanwhile, the convenience of mounting and dismounting the first adjustment component 4 by the worker is improved.

With continued reference to FIG. 1, the second adjustment component 5 includes a second connection section 51, each of two ends of the second connection section 51 is sleeved with a third T-shaped sleeve 52, the two third T-shaped sleeves 52 correspond to the two second support rods 32 one by one, and each second support rod 32 penetrates through one third T-shaped sleeve 52. The third T-shaped sleeve 52 is in sliding fit with the second support rod 32, such that the position of the second adjustment component 5 may be adjusted conveniently along the length direction of the second support rod 32, and meanwhile, the convenience of mounting and dismounting the second adjustment component 5 by the worker is improved.

Figure 2:
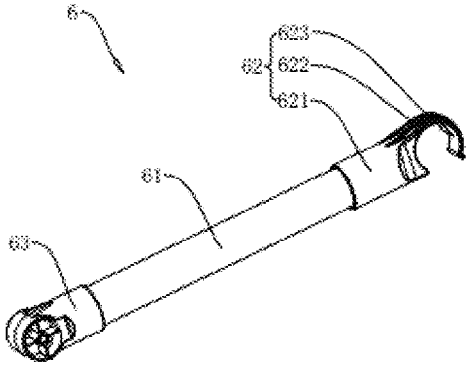
FIG. 2 is a schematic structural diagram of a connector in the embodiment of the present application.

Referring to FIGS. 1 and 2, the connector 6 includes a connection rod 61 and a clamping component 62, and an end of the connection rod 61 close to the first support frame 2 is rotatably connected with the first adjustment component 4 through a coupling sleeve 63. Specifically, the coupling sleeve 63 is sleeved on an end of the connection rod 61, and the coupling sleeve 63 is rotatably connected with the first connection section 41. An end of the connection rod 61 close to the second support frame 3 is detachably connected with the second adjustment component 5 through the clamping component 62. When the clamping component 62 is sleeved on the second adjustment component 5, the clamping component 62 clamps the second adjustment component 5, so as to fix the connector 6 on the second adjustment component 5.

Referring to FIG. 2, specifically, the clamping component 62 includes a socket 621 and a clamping portion 622 which are fixedly connected with each other. The socket 621 is sleeved on the connection rod 61 and fixedly connected with the connection rod 61, a snapping groove 623 for the third T-shaped sleeve 52 or the second connection section 51 to pass through is formed at one side of the clamping portion 622, and the clamping portion 622 is made of an elastic material and is elastically deformable, such that the second adjustment component 5 may be conveniently mounted in the snapping groove 623, and meanwhile, the convenience of dismounting the connector 6 and the second adjustment component 5 by the worker is also improved.

Referring to FIGS. 1 and 2, when the height of the target mechanism 1 is required to be adjusted, the included angle between the first support frame 2 and the second support frame 3 is first adjusted by rotating the second support frame 3. Then the position of the first adjustment component 4 is adjusted along the length direction of the first support frame 2, such that the first adjustment component 4 is moved to a suitable height. Then, the position of the second adjustment component 5 is adjusted along the length direction of the second support frame 3 to move the second adjustment component 5 to a suitable height. Finally, the connection rod 61 is rotated, the clamping component 62 is brought to move towards the second adjustment component 5 in the rotating process of the connection rod 61. When the clamping component 62 moves to the position of the second adjustment component 5 and the second adjustment component 5 penetrates through the snapping groove 623, the snapping groove 623 clamps the second adjustment component 5, such that the clamping portion 622 is fixed on the second adjustment component 5. At this point, the connector 6 has a fixing effect on the second support frame 3, which improves the stability of the target mechanism 1 supported by the first support frame 2 and the second support frame 3.

Figure 3:
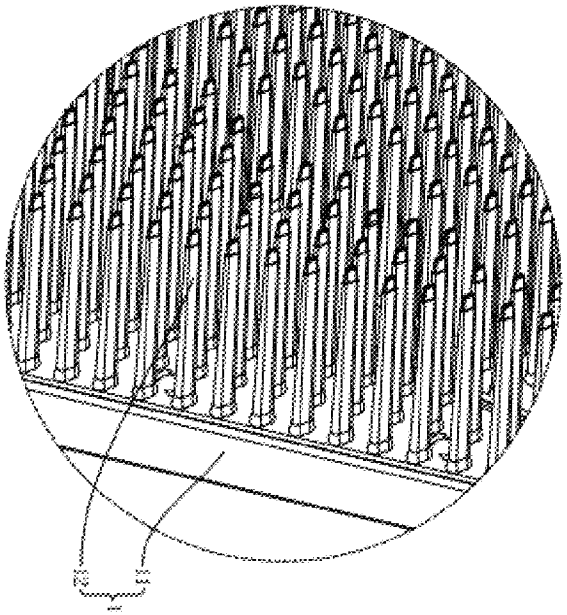
FIG. 3 is a partially enlarged view of portion A in FIG. 1.

Referring to FIGS. 1 and 3, the target mechanism 1 includes a dartboard 11, two slots are formed at a bottom of the dartboard 11, and an end of each of the two first support rods 21 close to the dartboard 11 is configured to be inserted into the corresponding slot, thus improving the convenience of mounting and dismounting the dartboard 11 by the worker. A surface of the dartboard 11 is provided with a plurality of columns 12, and distances between every adjacent columns 12 are equal. A cross sectional area of the column 12 at the top thereof is smaller than that of the column 12 at the bottom thereof, such that a dart may be caught by the bottoms of two adjacent columns 12 when it is thrown to the position between the two columns 12. With the design, the dart is not required to be provided with a spine portion, thus improving the safety of a game.

Referring to FIG. 3, the column 12 is made of an elastically deformable material, so as to ensure that the dart may be stably caught between the columns 12, reduce damage to the dart and the columns 12, and additionally improve the safety of the overall dart game apparatus.

The implementation principle of the present embodiment is as follows. The dart game apparatus is first assembled in use, and then, the included angle between the first support frame 2 and the second support frame 3 is adjusted by the adjustment mechanism to realize a stable support of the target mechanism 1 by the first support frame 2 and the second support frame 3. The structures of the target mechanism 1, the first support frame 2, the second support frame 3, the adjustment mechanism, and the like, are adopted in the present application, which brings convenience to disassembly and assembly of a stand while realizing a stable support. The end of the first support frame 2 is in insertion fit with the target mechanism 1, and the end of the second support frame 3 is rotatably connected with the target mechanism 1, such that the included angle between the first support frame 2 and the second support frame 3 may be adjusted by rotating the second support frame 3, so as to adjust the height of the target mechanism 1 while improving the convenience of use and storage of the dart game apparatus, which meets demands of different users and improves the flexibility and convenience of the game.

Second Embodiment

Referring to FIG. 1, the present embodiment is different from the first embodiment in that the target mechanism 1 is divided into a plurality of different regions by colors, and the regions correspond to different scores. The design makes the game more challenging and interesting, and a user may obtain corresponding scores for competition or entertainment according to the darts on different regions.

Third Embodiment

Referring to FIG. 3, the present embodiment is a further improvement on the basis of the second embodiment, a plurality of detection elements are further provided on the dartboard 11, and the detection elements are arranged in a matrix and correspond to the columns 12 in arrangement. Each detection element has a positive electrode film and a negative electrode film which are not connected with each other in an original state. When the dart is caught by the columns 12, the dart may be in contact with the dartboard 11, and the positive electrode film and the negative electrode film of the detection element at a corresponding position may be in contact and connected with each other based on the contact of the dart. The region with the dart may be determined by detecting the conducting detection element, and corresponding scoring is carried out. The design achieves an automatic scoring function, and improves the convenience and accuracy of the game.

Fourth Embodiment

Referring to FIG. 1, in the present embodiment, additional functions are further provided on the basis of the third embodiment, and specifically, the target mechanism 1 further includes a controller and a display screen 13. The controller is electrically connected with the detection element, to determine the region with the dart according to the conductive detection element and perform corresponding scoring. The display screen 13 is electrically connected with the controller, to display the scoring result. The design enables the user to visually check a throwing result and a score, thus enhancing the interactivity and experience of the game.

The above embodiments are preferred embodiments of the present application, and the protection scope of the present application is not limited thereby, and therefore, equivalent changes made according to the structure, shape and principle of the present application shall be covered by the protection scope of the present application.

LIST OF REFERENCE SIGNS

1 target Mechanism
11 dartboard
12 column
13 display Screen
2 first support frame
22 first cross rod
21 first support rod
23 first T-shaped sleeve
3 second support frame
31 second cross rod
32 second support rod
33 second T-shaped sleeve
4 first adjustment component
41 first connection section
42 adjustment sleeve
5 second adjustment component
51 second connection section
52 third T-shaped sleeve
6 connector
61 connection rod
62 clamping component
621 socket
622 clamping portion
623 snapping groove
63 coupling sleeve
7 buffer seat

What is claimed is:

1. A dart game apparatus, comprising a target mechanism, a first support frame, a second support frame and an adjustment mechanism, wherein an end of the first support frame is detachably connected with the target mechanism, an end of the second support frame is rotatably connected with the target mechanism, and the adjustment mechanism is arranged between the first support frame and the second support frame to adjust an included angle between the first support frame and the second support frame, wherein the adjustment mechanism comprises a first adjustment component, a second adjustment component and a connector, the first adjustment component is in sliding connection with the first support frame, the second adjustment component is in sliding connection with the second support frame, and a first end of the connector is rotatably connected with the first adjustment component, and wherein the connector comprises a connection rod and a clamping component, a first end of the connection rod is rotatably connected with the first adjustment component, a second end of the connection rod is detachably connected with the clamping component, a snapping groove for the second adjustment component to pass through is formed at a side of the clamping component, and when the clamping component is sleeved on the second adjustment component, the clamping component has a clamping effect on the second adjustment component.

2. The dart game apparatus according to claim 1, wherein the target mechanism comprises a dartboard, the end of the first support frame is configured to be mounted on the dartboard, a plurality of columns are provided on a surface of the dartboard, and a cross sectional area of each of the plurality of columns at a top thereof is smaller than the cross sectional area of each of the plurality of columns at a bottom thereof, such that a dart is caught by bottoms of two adjacent ones of the plurality of columns when the dart is thrown to a position between the two adjacent ones of the plurality of columns.

3. The dart game apparatus according to claim 2, wherein the plurality of columns are made of an elastically deformable material.

4. The dart game apparatus according to claim 2, wherein the target mechanism is divided into a plurality of different regions by different colors, and the plurality of different regions correspond to different scores, respectively.

5. The dart game apparatus according to claim 1, wherein the target mechanism comprises a display screen to display a scoring result.

* * * * *